US010844303B1

(12) United States Patent
Campbell

(10) Patent No.: US 10,844,303 B1
(45) Date of Patent: Nov. 24, 2020

(54) METHOD FOR THE PRODUCTION OF FUEL OIL

(71) Applicant: Gale Campbell, Lafayette, LA (US)

(72) Inventor: Gale Campbell, Lafayette, LA (US)

( * ) Notice: Subject to any disclaimer, the term of this patent is extended or adjusted under 35 U.S.C. 154(b) by 0 days.

(21) Appl. No.: 15/689,949

(22) Filed: Aug. 29, 2017

Related U.S. Application Data

(60) Provisional application No. 62/380,922, filed on Aug. 29, 2016.

(51) Int. Cl.
*C10L 1/14* (2006.01)
*C10L 1/196* (2006.01)
*C10L 1/198* (2006.01)

(52) U.S. Cl.
CPC ..... *C10L 1/143* (2013.01); *C10L 1/1963* (2013.01); *C10L 1/1985* (2013.01)

(58) Field of Classification Search
CPC combination set(s) only.
See application file for complete search history.

(56) References Cited

U.S. PATENT DOCUMENTS 9,299,068 B2 3/2016 Henry
9,369,179 B2 6/2016 Hariz
9,421,004 B2 8/2016 Roue
9,658,183 B2 5/2017 Wilsey
9,887,315 B2 2/2018 Kwak
2005/0172546 A1* 8/2005 Spivey ..... C10L 1/14 44/412
2005/0203232 A1* 9/2005 Rolland ..... C08J 5/18 524/425
2007/0284108 A1* 12/2007 Roes ..... E21B 36/04 166/302
2010/0251604 A1* 10/2010 Mahling ..... C10L 1/224 44/389
2016/0376263 A1* 12/2016 Patron ..... C07D 413/14 514/784

* cited by examiner

*Primary Examiner* — Ellen M McAvoy
*Assistant Examiner* — Chantel L Graham
(74) *Attorney, Agent, or Firm* — Roy Kiesel Ford Doody & North, APLC

(57) ABSTRACT

A method making fuel oil from refining residuals. Refining residuals are mixed with a diluent and an additive. Preferred diluents include diesel and reformed naphtha and combinations thereof. The additive is believed to be a cross-linked cyclic anhydride copolymer having an intrinsic viscosity (limiting viscosity, η) of between about 0.10 and 3.0 deciliters per gram and an average molecular weight between about 3,000 and 3,000,000. The additive includes excess aromatic hydrocarbons and a surfactant. In the preferred embodiment, the diluent and the residuals are mixed together in a ratio of about 3:1, by weight. The additive is introduced to this mixture in the amount of about 0.10 to 0.25 percent by weight. The components are thoroughly combined to yield a fuel oil having a viscosity that is about 25 to as much as about 70 percent lower than the viscosity of the same residual/diluent mixture lacking the additive.

27 Claims, 3 Drawing Sheets

| Light Residual (wt% ) | Cutter Stock (wt%) | Additive (wt %) | Viscosity ($mm^2/s$) |
|---|---|---|---|
| 100 | 0 | 0 | 253.58 |
| 70 | 30 | 0 | 94.12 |
| 75 | 25 | 0 | 108.36 |
| 77.5 | 22.5 | 0 | 115.99 |
| 75 | 24.75 | 0.25 | 80.00 |
| 77.5 | 22.25 | 0.25 | 93 |

| VFCR (wt% ) | Cutter Stock (wt%) | Additive (wt %) | Viscosity ($mm^2/s$) |
|---|---|---|---|
| 100 | 0 | 0 | 402.65 |
| 70 | 30 | 0 | 190.83 |
| 75 | 25 | 0 | 225.12 |
| 77.5 | 22.5 | 0 | 286.01 |
| 75 | 24.75 | 0.25 | 104.61 |
| 77.5 | 22.25 | 0.25 | 81.99 |

Figure 5

METHOD FOR THE PRODUCTION OF FUEL OIL

PRIORITY CLAIM

This application claims benefit of provisional U.S. Patent Application Ser. No. 62/380,922, filed Aug. 29, 2016, which is hereby incorporated by reference in its entirety.

BACKGROUND OF THE INVENTION

Field of the Invention

The invention relates to refining fuel in general and to refining fuel oil in particular.

Prior Art

During the catalytic cracking process of crude oil refining, a residual product is produced. These are simply the materials left after catalytic cracking has been performed on crude oil. These residuals are commonly referred to as "bottoms," as they are the heavier components of crude oil. Residuals typically have a high British Thermal Unit (BTU) value. However, they are difficult to use because they are commonly high in solid content; asphalt, asphaltoid, and asphaltene content; and paraffin content. It is usually very viscous, making handling difficult. Depending on the content of the particular bottom, viscosities on the order of 6,000 to 400,000 $mm^2/s$ at ambient temperature are not uncommon.

Residuals or refining bottoms will typically be between about 50 to 90 percent asphaltenes, asphaltoids, high molecular weight (above about 1,000,000 mw) paraffins, and solids.

These residuals are commonly used to make asphalt. However, another use is to convert the residual to fuel oil. The high BTU value makes this a suitable use for residuals, but the high viscosity makes it problematic.

To convert the residuals into fuel oil, a cutter is added. Typically, the cutter is diesel oil of number 2 quality. A significant amount of diesel is required. Up to a third of the overall volume of the finished fuel oil will frequently be diesel oil. The finished product will be a number 4 to number 6 grade fuel oil.

Diesel is, of course, a type of fuel oil. Thus, number 2 diesel is more valuable than no. 4 and especially no. 6 fuel oil. When the price disparity between no. 2 diesel and no. 6 fuel oil gets too wide, it ceases to make financial sense to blend up to a ⅓ of a more valuable commodity into the residuals in order to obtain a larger volume of lower value commodity.

In view of the foregoing, a more efficient method of converting petroleum refining residuals into fuel oil is desired.

SUMMARY OF THE INVENTION

A method making fuel oil from refining residuals is disclosed. The refining residuals, petrochemicals comprising about 50 to 90 percent asphaltenes, asphaltoids, high molecular weight (above about 1,000,000 mw) paraffins, and solids are mixed with a diluent and an additive. (As used herein, the term "about" means+/−ten percent, unless otherwise indicated.) When necessary, the refining residuals are heated to render them flowable—typically to between about 160° to 220° F. Once the residuals have been liquified, they are combined with a mixture of the diluent and the additive. Preferred diluents include diesel and reformed naphtha and combinations thereof.

The additive is believed to be a cross-linked cyclic anhydride copolymer having an intrinsic viscosity (limiting viscosity, η) of between about 0.10 and 3.0 deciliters per gram. The anhydride copolymer has an average molecular weight between about 3,000 and 3,000,000. The additive also includes excess aromatic hydrocarbons and a surfactant. In the preferred embodiment, the additive (about 0.10 to 0.25 percent by weight) is introduced to a mixture comprising about three quarters residuals and one quarter diluent (~3:1 ratio by weight). The result will be a fuel oil having a viscosity that is about 25 to as much as about 70 percent lower than the viscosity of a mixture of the same refining residuals and diluent without the additive.

BRIEF DESCRIPTION OF THE DRAWINGS

FIG. 5 is a chart illustrating the viscosity of two different residuals diluted with a diluent and identified quantities of an embodiment of the additive.

DETAILED DESCRIPTION OF THE INVENTION

Another difficult product to utilize in the refining field are a subset of reformed naphthas, that is naphthas that have undergone thermal and/or catalytic reformation. Reformed naphthas with an aromatic content below about 28 percent are suitable for making gasoline. Reformed naphthas above about 48 percent in aromatic content are suitable for use as a feed stock for manufacturing aromatic chemicals. However, reformed naphthas whose aromatic content is above about 28 percent but below about 48 percent have few good commercial uses. It contains too many aromatics for use in gasoline but not enough to be a good, or at least efficient, feedstock for aromatic chemical production.

Reformed naphtha with 28-48 percent aromatics is thus a low cost refining product that would be attractive for use as a diluent to convert refining residuals into fuel oil. However, reformed naphtha is too volatile for this application. Fuel oil requires a flash point between about 125° F. and about 210° F., and most preferably about 145° F. The use of reformed naphtha as a diluent would result in an end product having a flash point too low for use as fuel oil.

The inventor has developed an additive which can be used with reformed naphtha. The additive allows the reformed naphtha to be used as a diluent for refinery bottoms to produce fuel oil. This significantly reduces the cost of manufacturing the fuel oil because of the lower cost of reformed naphtha vs. diesel and other common cutter stocks.

It also reduces the overall amount of diluent required, regardless of which diluent is used.

The additive is prepared by admixing vinyl acetate copolymers with aromatic hydrocarbons. The preferred aromatics are C10-C12 alkylbenzenes and alkylnapthalenes primarily in the form of dimethylethylbenzene and tetramethylbenzene. The vinyl acetates and the aromatics are combined for about ¾ hour at 180 degrees F.

A preferred aromatic formulation is sold under the trade name Atosol 150 by Total Petrochemicals (CAS #64742-94-5). Similar chemicals are available from Chevron, Shell, and Exxon. The aromatic mixture will commonly contain naphthalene (CAS RN 91-20-3) in quantities of less than 10 percent and ethylbenzene and benzene in amounts of less than 1 percent. It also contains about 25 ppm butylated hydroxytoluene as an inhibitor.

Figure 1A:
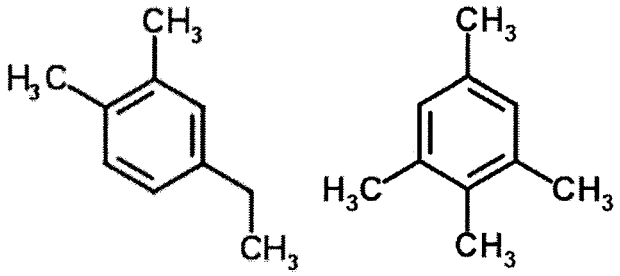
FIG. 1A is an illustration of a preferred form of dimethylethylbenzene and tetramethylbenzene utilized in an embodiment of the invention, namely 1, 2-dimethyl-4-ethylbenzene and 1, 2, 3, 5-tetramethylbenzene.
Figure 1B:
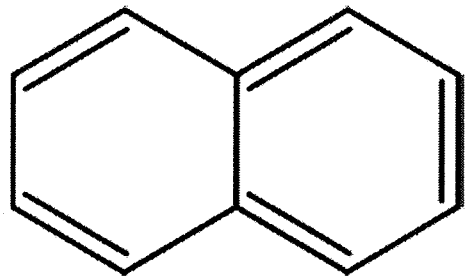
FIG. 1B is an illustration of the preferred form of naphthalene utilized in an embodiment of the invention.

The dimethylethylbenzene is believed to include 1, 2-dimethyl-4-ethylbenzene and the tetramethylbenze is believed to include 1, 2, 3, 5-tetramethylbenzene, each of which are illustrated in FIG. 1A. The naphthalene is believed to have the form shown in FIG. 1B.

Figure 1C:
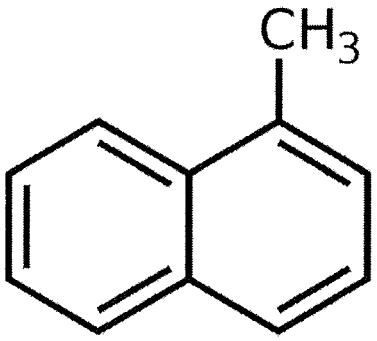
FIG. 1C is an illustration of a preferred form of methylnaphthalene utilized in an embodiment of the invention.

Another suitable aromatic blend include C12-C15 alkylnaphthalenes primarily in the form of methylnaphthalenes. The preferred alkylnaphthalenes are sold under the trade name Atosol 200 by Total Petrochemicals (CAS #64742-94-5). This aromatic mixture will also commonly contain naphthalene (CAS RN 91-20-3) in quantities of less than 10 percent and ethylbenzene and benzene in amounts of less than 1.0 percent. It also contains about 25 ppm butylated hydroxytoluene as an inhibitor. An example of methylnaphthalene is shown in FIG. 1C.

Substituting C12-C15 alkylnaphthalenes for some or all of the C10-C12 alkylbenzenes and alkylnapthalenes, preferably by substituting Atosol 200 for Atosol 150, will increase the flash point of the final product. The appropriate ratio will depend upon the flash point requirements and the composition of the reformed naphtha. In one preferred embodiment, the ratio of Atosol 150 to Atosol 200 is about 1.5:1.

Figure 2:
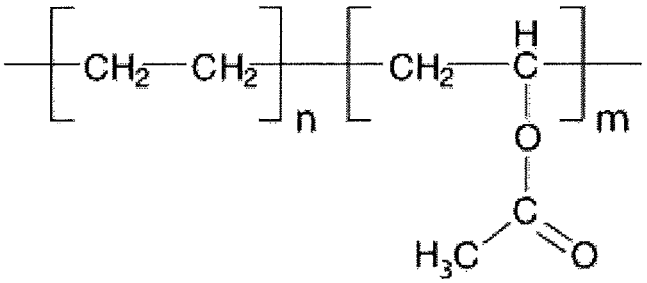
FIG. 2 is an illustration of the preferred form of ethylene vinyl acetate utilized in an embodiment of the invention.

In the preferred embodiment, the vinyl acetate comprises two ethylene vinyl acetates: ethylene vinyl acetate 28-10 and ethylene vinyl acetate 40-30 (CAS 24937-78-8). The 40 and 28 in the foregoing designations refer to the percentage of vinyl acetate in each reactant. The balance in each is ethylene. The ethylene vinyl acetates used in the preferred embodiment are believed to have the structure illustrated in FIG. 2, where n is the number of sequential molecules highlighted in the co-polymer and m is mol percentage of vinyl acetate in the molecule.

Figure 3:
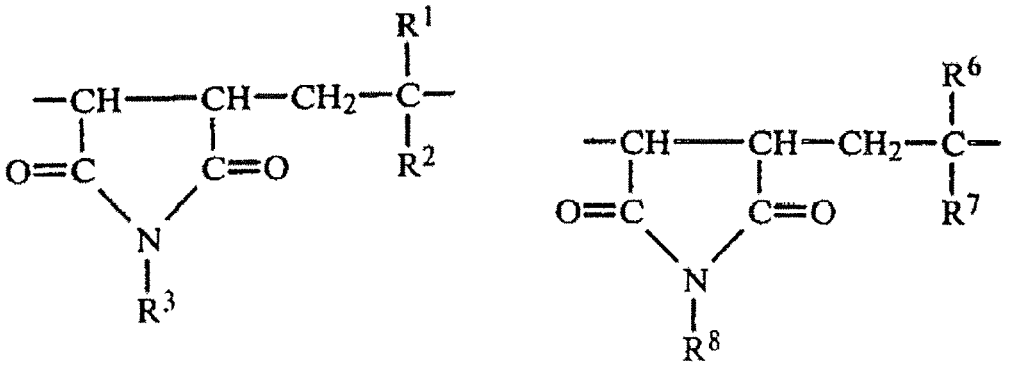
FIG. 3 is an illustration of two forms of maleic anhydride amide copolymer utilized in an embodiment of the invention.

Maleic anhydride copolymers and a polyether polyol are next added to the mixture. The maleic anhydride copolymers are preferably maleic anhydride amide copolymers. The preferred maleic anhydride amide is available from AkzoNobel under the brand name Armohib PC-308. The maleic anhydride amide copolymer is believed to be comprised primarily of a mixture of molecules having one or both of the structures illustrated in FIG. 3.

Figure 4:
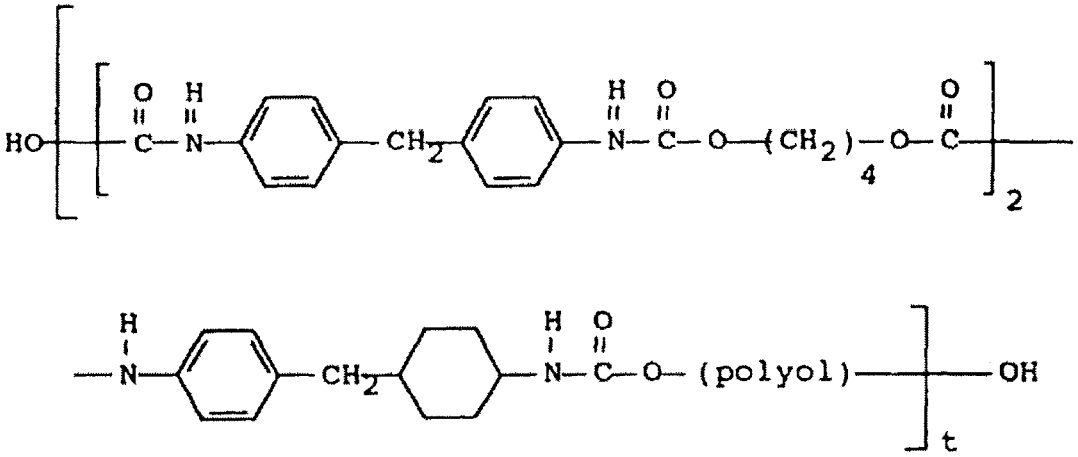
FIG. 4 is an illustration of a polyether polyol utilized in an embodiment of the invention.

The preferred polyether polyol is available from AkzoNobel under the brand name Witbreak DRE-8164. The polyether polyol is believed to have the structure illustrated in FIG. 4.

Once the maleic anhydride copolymers and the polyether polyol are added, the mixture is heated to at least about 280 degrees F. for about 4 to 5 hours., Continuous mixing is maintained, preferably in a closed container, thereby retaining any distillate. The mixture is then allowed to cool to about 100-110 degrees F., at which point additional aromatics and a surfactant are added.

The additional aromatics are not believed to be critical to the reaction, which is believed to be complete by the time the extra aromatics are added. Rather, the second addition of aromatics is believed to serve primarily as a diluent. Many aromatic and aliphatic compositions would serve equally well in this capacity.

The preferred surfactant is a C 9-C11 ethoxylated alcohol. It is available under the brand name Tomadol 91-2.5 and is sold by Air Products and Chemicals, Inc. of Allentown, Pa. The surfactant has two primary functions in the additive. First, it helps keeps the additive components in solution, keeping the additive fluid during shipping and storage. Second, it helps the additive enter the residuals to convert the residual into a fuel oil.

The preferred relative percentages of each component are provided below. The percentages provided are relative to the entire composition, rather than the individual stages. All percentages are by weight. The aromatics are listed twice because they are preferably added twice.

| | |
|---|---|
| aromatics ($1^{st}$ stage) | 67.40% |
| (C10-C12 alkylbenzenes and alkylnapthalenes - 40.40%) | |
| (C12-C15 alkylnaphthalenes - 27.00%) | |
| ethylene vinyl acetate | 5.85% |
| (28-10 - 2.25%; 40-30 - 3.60%) | |
| maleic anhydride amide copolymer | 14.00% |
| polyether polyol | 6.75% |
| surfactant | 1.00% |
| aromatics ($2^{nd}$ stage) | 5.00% |
| (C12 - C15 alkylnaphthalenes - 5.00%) | |

The foregoing process is believed to be a Diels-Alder reaction. It is believed to yield a cross-linked cyclic anhydride copolymer having an intrinsic viscosity (limiting viscosity, of between about 0.10 and 3.0 deciliters per gram. This corresponds to an average molecular weight between about 3,000 and 3,000,000. The aromatic components are believed to serve as catalysts in the above reaction, allowing the maleic anhydride to react with the vinyl acetate.

Once the additive is prepared, it is preferably mixed with reformed naphtha, diesel, or another cutter stock. The amount of both the additive and the cutter stock will depend upon the amount of the residuals to be treated. However, typical amount of the additive will be between 0.10 and 0.25 percent of the final product, by weight.

In operation, the residuals are heated to make them flowable. The temperature will vary depending on the characteristics of the particular residual but temperatures between about 160° to 220° F. are typical. The cutter stock and additive will be added to the residuals. This may be done on a batch basis; however, in a plant setting, adding the additive and cutter stock to the residuals in line will typically be most convenient.

The preferred mixing method utilizes a static mixer. Suitable mixers are available from Sulzer Corp. of Winterthur, Switzerland. The cutter stock and additive are injected into the residual flow line. The preferred flow rate ranges from 2500 gallons per minute to 7000 gallons per minute, with the rate of addition of cutter stock and additive varying accordingly. The components will be thoroughly combined upon passing through the static mixer.

After mixing, the end result is a fuel oil, typically ranging from grade 6 to 4. It will remain liquid, facilitating transport and pumping without the need for heat. Other characteristics of the finished product are discussed below.

The chart in FIG. 5 illustrates the viscosity of two different residuals diluted with a cutter stock (no. 2 diesel) containing identified quantities of the additive.

The residuals tested were a light residual and a heavier vacuum flashed cracked residual (VFCR). Kinematic viscosities were tested using ASTM D 445 c. cSt. All tests were performed at 100° C., except for the test of the pure residuals, which were so viscous that they had to be heated to 150° C. for the test to be performed.

The BTU content was determined for a finished fuel oil manufactured using the additive. The tested fuel oil was 77.5 percent VFCR, 22.25 percent no. 2 diesel, and 0.25 percent additive. The sample was measured to have a heat of combustion of about 18500 BTU/lb. However, use of reformed naphtha as a cutter, in combination with the additive, is expected to increase the BTU of the finished fuel oil by about 20 to 30 percent compared with fuel oil made solely from residuals and a diesel cutter.

The tested samples were 0.25 percent additive. However, the inventor believes that 0.10 to 0.15 percent additive by weight, in combination with the cutter stock, will be sufficient to reduce the viscosity of the residual by 30 to 40 percent.

The tests were performed using no. 2 diesel. However, the additive will reduce the quantity of cutter stock needed to convert the residuals to fuel oil. This will be advantageous regardless of whether naphtha, diesel, or any other cutter stock is used. Less cutter stock used equals lower production cost in the finished fuel oil, regardless of the cutter stock used. Reductions on the order of 25 to 30 percent in the amount of cutter stock needed to convert residuals to fuel oil can be expected using the additive.

The embodiments shown in the drawings and described above are exemplary of numerous embodiments that may be made within the scope of the appended claims. It is contemplated that numerous other formulations may be used, and the material of each component may be selected from numerous materials other than those specifically disclosed. In short, it is the applicant's intention that the scope of the patent issuing herefrom will be limited only by the scope of the appended claims.

I claim:

1. A method of making fuel oil comprising:

forming an additive via steps comprising admixing vinyl acetate copolymers with aromatic hydrocarbons for at least about 45 minutes at about 180 degrees F.; adding a maleic anhydride copolymer and a polyether polyol to the admixture; increasing the temperature to about 280 degrees F. and mixing the components continuously for at least about 4 hours; and combining about 0.10 to about 0.30 percent by weight of said additive; about 20 to 25 percent by weight of a diluent; and the balance residuals from refined crude oil; and blending the same until at least a grade 6 fuel oil is obtained.

2. A method of making fuel oil according to claim 1 wherein about 50 to 90 percent by weight of said residuals are comprised of asphaltenes, asphaltoids, paraffins having a molecular weight above about 1,000,000, and solids.

3. A method of making fuel oil according to claim 2 wherein said diluent comprises diesel.

4. A method of making fuel oil according to claim 2 wherein said diluent comprises reformed naphtha.

5. A method of making fuel oil according to claim 4 wherein said reformed naphtha comprises about 28 to 48 percent aromatics by weight.

6. A method making fuel oil according to claim 5 wherein said aromatic hydrocarbons are selected from a group comprising C10-C12 alkylbenzenes and alkylnapthalenes.

7. A method of making fuel oil according to claim 5 wherein said aromatic hydrocarbons are selected from a group comprising dimethylethylbenzene and tetramethylbenzene.

8. A method of making fuel oil according to claim 6 where said aromatic hydrocarbons further comprise naphthalene.

9. A method of making fuel oil according to claim 8 wherein said aromatic hydrocarbons are comprised of not more than about than 10 percent naphthalene, by weight.

10. A method of making fuel oil according to claim 9 wherein said aromatic hydrocarbons further comprise ethylbenzene and benzene.

11. A method of making fuel oil according to claim 10 wherein said aromatic hydrocarbons are comprised of about 25 ppm butylated hydroxytoluene.

12. A method of making fuel oil according to claim 6 wherein said vinyl acetate copolymers comprise ethylene vinyl acetates.

13. A method of making fuel oil according to claim 6 wherein said maleic anhydride copolymer comprises a maleic anhydride amide copolymer.

14. A method of making fuel oil according to claim 5 wherein said aromatic hydrocarbons are selected from a group comprising C12-C15 alkylnaphthalenes.

15. A method of making fuel oil according to claim 5 where said aromatic hydrocarbons comprise methylnaphthalenes.

16. A method of making fuel oil according to claim 15 where said aromatic hydrocarbons further comprise naphthalene.

17. A method of making fuel oil according to claim 16 wherein said naphthalene comprises not more than about than 10 percent of said aromatic hydrocarbons.

18. A method of making fuel oil according to claim 15 wherein said aromatic hydrocarbons further comprise ethylbenzene and benzene.

19. A method of making fuel oil according to claim 18 wherein said aromatic hydrocarbons further comprise about 25 ppm butylated hydroxytoluene.

20. A method of making fuel oil according to claim 14 wherein said vinyl acetate copolymers comprise ethylene vinyl acetates.

21. A method making fuel oil according to claim 14 wherein said maleic anhydride copolymer comprises a maleic anhydride amide copolymer.

22. A method of making fuel oil according to claim 1 wherein said additive is formed in a closed chamber.

23. A method of making fuel oil according to claim 1 further comprising adding a surfactant to said additive.

24. A method of making fuel oil according to claim 23 wherein said surfactant comprises a C 9-C11 ethoxylated alcohol.

25. A method of making fuel oil according to claim 1 where said maleic anhydride and said vinyl acetate are present in a ratio of at least about 2.4:1 by weight.

26. A method of making fuel oil according to claim 1 wherein said additive comprises a cross-linked cyclic anhydride copolymer.

27. A method of making fuel oil according to claim 26 wherein said cross-linked cyclic anhydride copolymer has an intrinsic viscosity of between about 0.10 and 3.0 deciliters per gram.

* * * * *